US006263793B1

(12) United States Patent
Muth

(10) Patent No.: US 6,263,793 B1
(45) Date of Patent: Jul. 24, 2001

(54) CYLINDER ARRANGEMENT FOR WEB-FED ROTARY PRINTING PRESS

(75) Inventor: Bernhard Walter Wolfgang Muth, Veitshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/403,018

(22) PCT Filed: Apr. 14, 1998

(86) PCT No.: PCT/DE98/01054

§ 371 Date: Oct. 18, 1999

§ 102(e) Date: Oct. 18, 1999

(87) PCT Pub. No.: WO98/47708

PCT Pub. Date: Oct. 29, 1998

(30) Foreign Application Priority Data

Apr. 18, 1997 (DE) ..... 197 16 283

(51) Int. Cl.[7] ..... B41F 5/04

(52) U.S. Cl. ..... 101/219; 101/218

(58) Field of Search ..... 101/219, 218, 101/216, 232, 178, 171

(56) References Cited

U.S. PATENT DOCUMENTS

| | | | | |
|---|---|---|---|---|
| 4,369,705 | | 1/1983 | Gelinas | 101/177 |
| 4,398,464 | * | 8/1983 | Morbitzer et al. | 101/177 |
| 4,696,229 | * | 9/1987 | Bezler et al. | 101/177 |
| 4,815,377 | * | 3/1989 | Skiera | 101/218 |
| 4,833,982 | * | 5/1989 | Liebert et al. | 101/177 |
| 5,937,755 | * | 11/1999 | Preuss et al. | 101/218 |
| 5,979,317 | * | 11/1999 | Singler | 101/220 |

FOREIGN PATENT DOCUMENTS

| | | |
|---|---|---|
| 195 40 573 C1 | 11/1998 | (DE) . |
| 0193012 A2 | 2/1986 | (EP) . |

* cited by examiner

*Primary Examiner*—John S. Hilten
*Assistant Examiner*—Anthony H. Nguyen
(74) *Attorney, Agent, or Firm*—Jones, Tullar & Cooper, PC

(57) ABSTRACT

In a cylinder arrangement for a rotary printing press, the backlashes caused by traction of the drive gears must be compensated for. This is accomplished by using a cylinder that is able to compensate for the backlash and positioning the cylinder at a determinable rotational angle differential with respect to another cylinder in the cylinder arrangement.

6 Claims, 3 Drawing Sheets

CYLINDER ARRANGEMENT FOR WEB-FED ROTARY PRINTING PRESS

FIELD OF THE INVENTION

The present invention relates to a cylinder arrangement for rotary printing presses.

DESCRIPTION OF THE PRIOR ART

It is known to arrange cylinders in print units of web-fed rotary printing presses, which cylinders are connected, fixed against relative rotation, with a drive gear wheel and whose gear wheels are driven in a drive gear wheel train.

It is disadvantageous here that in the course of the engagement of the gear wheels with each other, play in individual tooth flanks is created, the sum of which prevents a symmetrical position of the angles of rotation of individual cylinders in respect to each other.

SUMMARY OF THE INVENTION

The object of the present invention is based on producing a cylinder arrangement for a print unit of a rotary printing press.

In accordance with the present invention, this object is attained by the provision of a cylinder arrangement of a bridge printing unit that includes two blanket cylinders and two plate cylinders. Each cylinder carries a drive gear wheel. These drive gear wheels are in engagement with each other in a non-printing position. The plate cylinders are rotatable in opposite directions, but through corresponding angels of rotation between non-printing and printing positions.

The advantages which can be achieved by means of the present invention consist, in particular, in that it is possible to work on the cylinders, which are in a definite play-compensated angle of rotation position, at the same time, so that previous setup times of the print unit can be reduced. This applies particularly in connection with the assembly and disassembly of flexible printing plates, whose beveled edges must be either positioned in small slits in the cylinder circumference, or removed from these small plate-beveled edge receiving slits.

BRIEF DESCRIPTION OF THE DRAWINGS

Preferred embodiments of the present invention are represented in the drawings, and will be described in greater detail in what follows. Shown are in.

DESCRIPTION OF THE PREFERRED EMBODIMENTS

Figure 1:
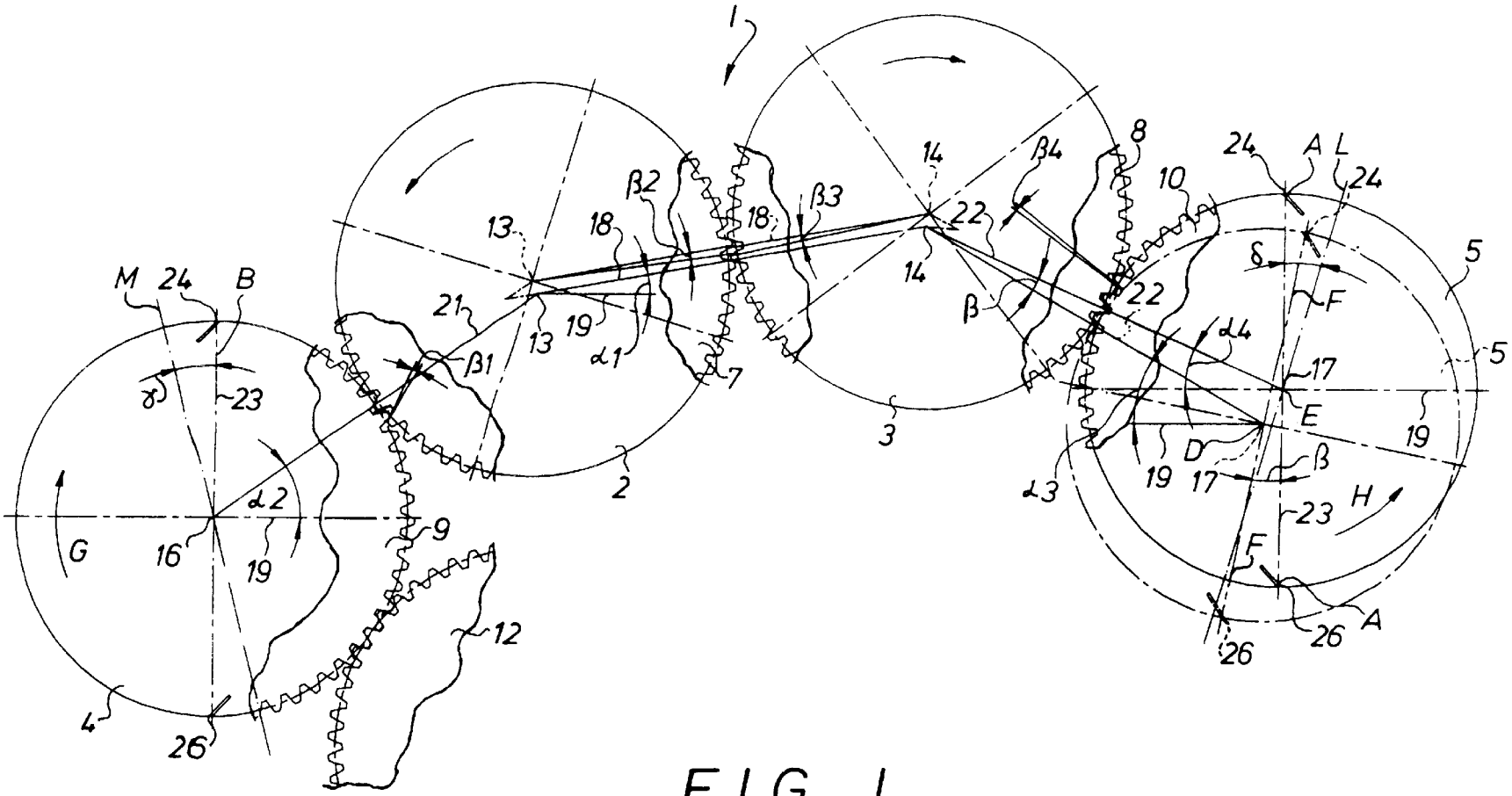
FIG. 1 a schematic representation of a bridge printing unit in the non-printing position in accordance with the present invention.

The bridge printing unit 1 consists of two rubber blanket cylinders 2, 3 acting against each other, or respectively against a paper web, not represented, and to which a plate cylinder 4, 5 has been assigned on each side.

Each rubber blanket or plate cylinder 2 to 5 is connected, fixed against relative rotation, with a drive gear wheel 7, 8, 9, respectively. In this way a drive gear wheel train 7 to 10 has been created which gear wheel train is driven, for example, by means of a drive gear wheel 12.

Figure 3:
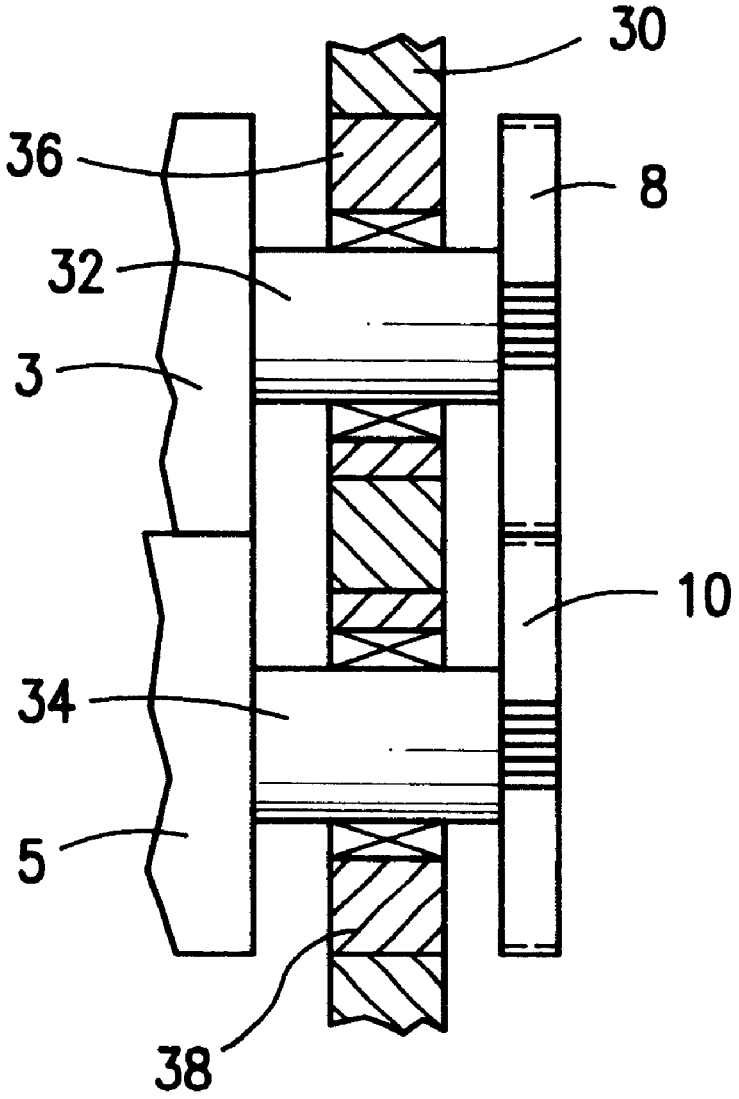

The cylinders 2 to 5 are rotatably seated, fixed in lateral frames 30 by means of, for example, axle journals, with journals 32 and 34 for cylinders 3 and 5 shown in FIG. 3 and have respective axes of rotation 13, 14, 16, 17 extending parallel in respect to each other. Dashed reference mark lines of the axes of rotation 13, 14 indicates a non-printing position of the rubber blanket cylinders 2, 3. For better understanding, the plate cylinder 5' with its associated axis of rotation 17' is in an initially uncorrected position D, shown by dash-dotted lines and with dashed reference numeral lines.

With the axle journals 34 of the plate cylinders 5 in the uncorrected position D, the beginnings 24, 26 of the plate beveled edge received slits have an angle of rotation position F, which has an angle of rotation deviation β, for example of 4°, with respect to the desired or corrected vertical angle of rotation position A of the beginnings 24, 26 of the slits—represented in solid line —.

The axle journals of the rubber blanket cylinders 2 and 3 and the plate cylinders 4 and 5 are seated, for example in eccentric bushings, so that the represented non-printing position becomes possible. The eccentric bushing for cylinder 3 is shown at 36 in FIG. 3.

A central line 18, which connects the two axes of rotation 13, 14 of the rubber blanket cylinders 2, 3, to their printing positions extends between the left rubber blanket cylinder 2 and the right rubber blanket cylinder 3 at an angle α 1 of approximately 10° in respect to a horizontal line 19. A central line 21 connecting the two axes of rotation 16, 13 of the left plate and rubber blanket cylinders 4, 2 extends between the left plate cylinder 4 and the left rubber blanket cylinder 2 at an angle α 2 of approximately 30° in respect to the horizontal line 19. A central line 22 connecting the two axes of rotation 17, 14 of the right plate and rubber blanket cylinders 5, 3, when the right plate cylinder 5 is in its uncorrected position terminates at the point D—represented in dash-dotted lines—and extends at an angle α 3 of 20° in respect to the horizontal line 19. All central lines 18, 21, 22, or respectively the associated angle sizes of α 1 to α 3, are referenced to a printing position of the cylinders 2 to 5. Accordingly, the following applies to the cylinder arrangement for the bridge printing unit during a printing position: α 3=α 2 minus α 1.

During a stop of the bridge printing unit 1, the two rubber blanket cylinders 2, 3 are shifted into the non-printing position shown. At this time the drive gear wheels 7 to 10 are still in engagement with each other; but a very large play in the gear wheels is created. This is a result of the separation of the two blanket cylinders from each other and the resultant partial unmeshing of the gear teeth of the gear wheels 7 and 8 of the blanket cylinders 2 and 3. While the left plate cylinder 4 is fixed and has a definite angle of rotation position B in which a vertical line 23 passes respectively through the beginning of a narrow slit 24, 26, which starts in the cylinder surface and extends in an axis-parallel direction—, an added-up deviation from the angle of rotation β of approximately 4° results at the right plate cylinder 5 which is still in the right position D. For example, between the gear wheels 9 and 7 and the gear wheels 8 and 10 a respective deviation from the angle of rotation β 1 of 1°, or respectively β 4 of 1° results. A deviation from the angle of rotation, for example respectively β 2 of 1° and β 3 of 1°, results. The resultant deviation of the angle of rotation B is the cumulative result of the large play in the gear wheels which results from the shifting of the blanket cylinders 2 and 3 to their non-printing position.

In order to bring the plate cylinder 5 into such a corrected position A, that the beginnings of the slits 24, 26 in the non-printing or corrected position are A of plate cylinder 5 located synchronously in respect to the beginnings of the slits 24, 26 of the plate cylinder 4, it must be possible to position the plate cylinder 5 with the gear wheel 10 in a direction counter to the positioning direction of rotation around the rubber blanket cylinder 3 adjoining it in the direction of the plate cylinder 4 in a play-compensating manner. In the process' a product is formed from the sum of the deviations from the axes of rotation β1 to β 4 and from a constant k, which is subtracted from the difference of the angle α 2 minus α 1. The following therefore applies for a concrete angle $$\alpha 4=\alpha 2 \text{ minus } \alpha 1 \text{ minus } k\times\text{the sum of } \beta 1 \text{ to } \beta\ n$$

$$\alpha 4=30^\circ-10^\circ-10^\circ-0.25\times(1+1+1+1)$$

$$\alpha 4=19^\circ$$

With a set-off of the same size of the two rubber blanket cylinders 2, 3, the factor k lies at 0.25. The factor k is furthermore a function of the angle and the size of the pivot movement of the drive gear wheels 7, 8 for the rubber blanket cylinders 2, 3 in the non-printing position, and can lie between 0.2 and 0.6.

A corrected angle α 4 of 19° between the central line 22 and a horizontal line 19 necessitates the shifting of plate cylinder 5 to a new, corrected position E of the axis of rotation 17 of the plate cylinder 5. A difference angle α=1° therefore exists between the uncollected position D to α 3—the corrected position Eα 4 (enlarged representation). Thus, in a non-printing position of the bridge unit 1, a corrected vertical position A of the beginnings of the slits 24, 26 of the plate cylinder 5 is achieved. To achieve this corrected position E of the axis of rotation 17, the axle journals of the plate cylinder 5 can be seated in the lateral frame in the position E from the beginning.

Another preferred embodiment consists in that the axle bearings of the plate cylinder 5 are arranged to be adjustable in their position, so that a position adjustment from the position D to the position E opposite the positioning direction of rotation can take place. This is accomplished by the eccentric bushing 38 shown in FIG. 3.

In accordance with a further preferred embodiment, the invention consists in that in a non-printing position, angles of rotation γ, δ of cylinders which are respectively the same, namely the rubber blanket cylinders 2, 3, or respectively the plate cylinders 4, 5 in particular, have the same size γ, δ in relation to a vertical line A, B and a reference point, for example a beginning of a slit 24, 26 on the plate cylinder 4, 5, but a different direction, i.e. a direction of rotation G. H.

As depicted, the angle of rotation δ between the vertical position A of the plate cylinder 5 and the beginning of the slit 24 is zero, or respectively the angle of rotation δ between the vertical position B of the plate cylinder 4 and the beginning of the slit 24 is zero.

However, the angle of rotation γ, 67 can also be a size diverging from zero degrees, for example 15°, which is represented in the drawings at the plate cylinder 4 as the angle δ between a angle of rotation position M and the vertical line B, or respectively at the plate cylinder 5 as an angle δ between the angle of rotation position L and the vertical line A. At the plate cylinder 4, 5, this angle of rotation gamma, delta respectively has a different direction G. H.

The start of a cylinder depression can also be used as a reference point on the cylinders 2, 3, 4, 5.

Figure 2:
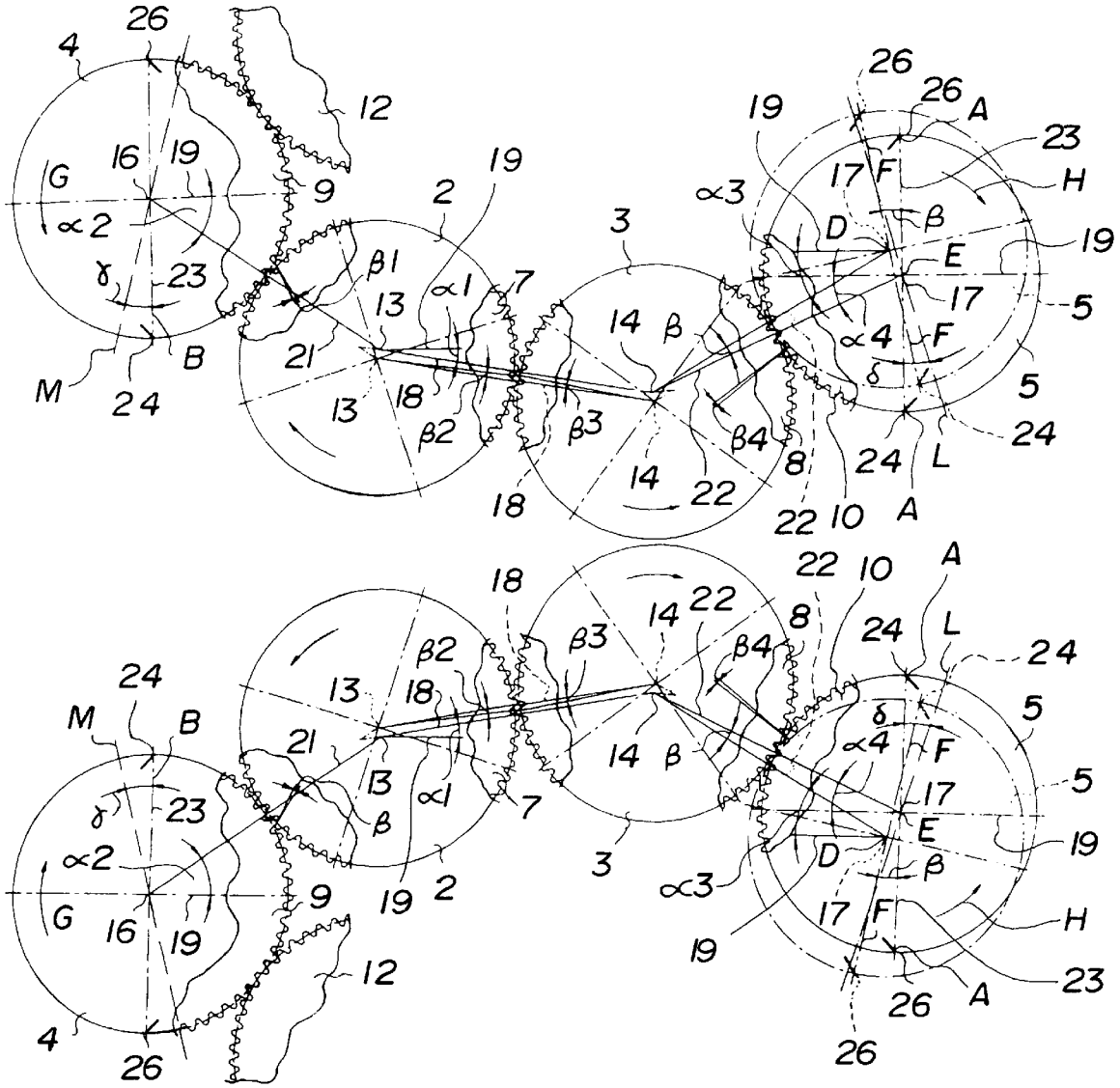
FIG. 2 a schematic representation of an arrangement of two bridge printing units arranged as an H printing unit; and in FIG. 3 a schematic representation of a portion of a support for a blanket cylinder and a plate cylinder in accordance with the present invention.

It is also possible to arrange two bridge printing units above each other mirror-reversed in respect to a horizontal line as a so-called H printing unit. This is shown in FIG. 2.

While preferred embodiments of a cylinder arrangement for a web-fed rotary printing press in accordance with the present invention have been set forth fully and completely hereinabove, it will be apparent to one of skill in the art that a number of changes in, for example, the overall structure of the web-fed rotary printing press, the source of power to drive the gear wheels, and the like could be made without departing from the true spirit and scope of the present invention which is accordingly to be limited only by the following claims.

What is claimed is:

1. A cylinder arrangement of a bridge printing unit comprising:

a first blanket cylinder and a second blanket cylinder, said first and second blanket cylinders being adapted to be shiftable between a printing position and a non-printing position;

a first plate cylinder contacting said first blanket cylinder and a second plate cylinder contacting said second blanket cylinder, said second plate cylinder being adapted to be shifted about said second blanket cylinder between an uncorrected position and a corrected position;

a drive gear secured, fixed against rotation, to each of said first and second blanket cylinders and to each of said first and second plate cylinders, said drive gears forming a drive gear wheel train for the bridge printing unit;

a first angle of rotation of said first plate cylinder defined by a first vertical line and a first reference point on said first plate cylinder in said non-printing position of said first and second blanket cylinders; and a second angle of rotation of said second plate cylinder defined by a second vertical line and a second reference point on said second plate cylinder when said second plate cylinder is in said corrected position, said first and second angels of rotation having the same size and opposing directions.

2. The cylinder arrangement of claim 1 wherein said first and second reference points on said first and second plate cylinders are cylinder depressions and further wherein a sum of said first and second angles of rotation is 0°.

3. The cylinder arrangement of claim 1 wherein in said non-printing position, said first plate cylinder is positioned in a corrected position at a third angle with respect to said first blanket cylinder.

4. The cylinder arrangement of claim 3 wherein said third angle is formed as a product of the sum of flank gear play angles between said drive gear wheels for said first and second plate cylinders and said first and second rubber blanket cylinders, and a constant.

5. The cylinder arrangement of claim 4 wherein said constant lies between 0.2 and 0.6.

6. The cylinder arrangement of claim 1 further including third and fourth rubber blanket cylinders and third and fourth plate cylinder cooperating with said first and second rubber blanket cylinders and said first and second plate cylinders to define an H-shaped printing unit.

* * * * *